United States Patent [19]

Nocek et al.

[11] Patent Number: 4,787,522

[45] Date of Patent: Nov. 29, 1988

[54] BAG STORAGE DEVICE

[75] Inventors: Robert S. Nocek, Stamford, Conn.; George C. Perry, Jr., Summit, N.J.

[73] Assignee: Minigrip, Inc., Orangeburg, N.Y.

[21] Appl. No.: 109,062

[22] Filed: Oct. 16, 1987

[51] Int. Cl.[4] ..... A47F 7/00

[52] U.S. Cl. ..... 211/71; 211/45; 211/72; 248/95

[58] Field of Search ..... 211/45, 46, 71, 72, 211/73; 248/95, 97, 99; 312/183, 184

[56] References Cited

U.S. PATENT DOCUMENTS

| | | | |
|---|---|---|---|
| 1,402,635 | 1/1922 | Meyer | 211/74 |
| 4,111,504 | 9/1978 | Montiel | 312/184 X |
| 4,228,905 | 10/1980 | Cammarota | 211/71 |
| 4,269,317 | 5/1981 | Rubenstein et al. | 211/72 |

FOREIGN PATENT DOCUMENTS

| | | | |
|---|---|---|---|
| 1401447 | 4/1965 | France | 211/73 |
| 1398885 | 4/1965 | France | 211/73 |

*Primary Examiner*—Robert W. Gibson, Jr.
*Attorney, Agent, or Firm*—Hill, Van Santen, Steadman & Simpson

[57] ABSTRACT

A storage device for bags of selected width and wherein each of the bags has a top end portion with a rib extending thereacross and the rib being of greater thickness than the bag top end portion, the device comprising a member having a slot substantially as long as the bag width, the slot being narrower than the rib thickness but of a width which will freely receive the bag top portion thickness, and an entrance into the slot through which the top end portion of the bag can be slidably inserted for storage of the bag with the rib at one side of the slot and the remainder of the bag at the opposite side of the slot. The device may taken various desirable forms such as an upright display stand on which the bags can be stored in display orientation, or a storage drawer in which the bags are supported on a slotted drawer bottom panel.

17 Claims, 2 Drawing Sheets

BAG STORAGE DEVICE

BACKGROUND OF THE INVENTION

This invention relates to storage devices for the orderly storage of bags such as may carry a preferred contents, and is particularly concerned with the storge of bags of the kind having a rib along the top thereof such as may be provided by extruded plastic reclosable fastener means.

Various and sundry storage devices for containers, including bags, have been proposed. By way of example, display racks for canned goods are disclosed in U.S. Pat. Nos. 2,043,070 and 2,058,542. U.S. Pat. No. 2,307,993 discloses a rack for displaying flashlights. U.S. Pat. No. 2,606,665 discloses a display rack having an arrangement of tabs for supporting filled bags.

There is, however, still need for simple, efficient bag storage devices, and particularly such devices which will accommodate bags equipped with rib structure across the top end portions thereof, such as provided by extruded plastic reclosable fastener structure. It is an important of the present invention to provide such a storage device.

Another object of the invention is to provide a new and improved bag storage rack on which the bags can be readily maneuvered into place or removed without requiring any special clips or retaining mechanism, but which will provide for direct interlocking engagement between the device and existing rib structure on the bags.

Still another object of the invention is to provide a new and improved slotted bag storage device for bags of the kind equipped with extruded plastic reclosable fasteners.

Pursuant to the present invention there is provided a storage device for bags of selected width and length and each having a top end portion with a rib extending thereacross, and said rib being of greater thickness than the thickness of the top end portion, said device comprising a member having at least one slot at least as long as the bag width, the slot being narrower than the ri thickness but of a width which will freely receive the bag top portion thickness, and an entrance into the slot through which the top end portion of the bag can insert by movement longitudinally along the slot for storage of the bag on the device with the rib located at one side of the slot and the remainder of the bag located at the opposite side of the slot.

Other objects, features and advantages of the present invention will be readily apparent from the following description of representative embodiments thereof, taken in conjunction with the accompanying drawings, although variations and modifications may be effected without departing from the spirit and scope of the novel concepts embodied in the disclosure, and in which.

Figure 1:
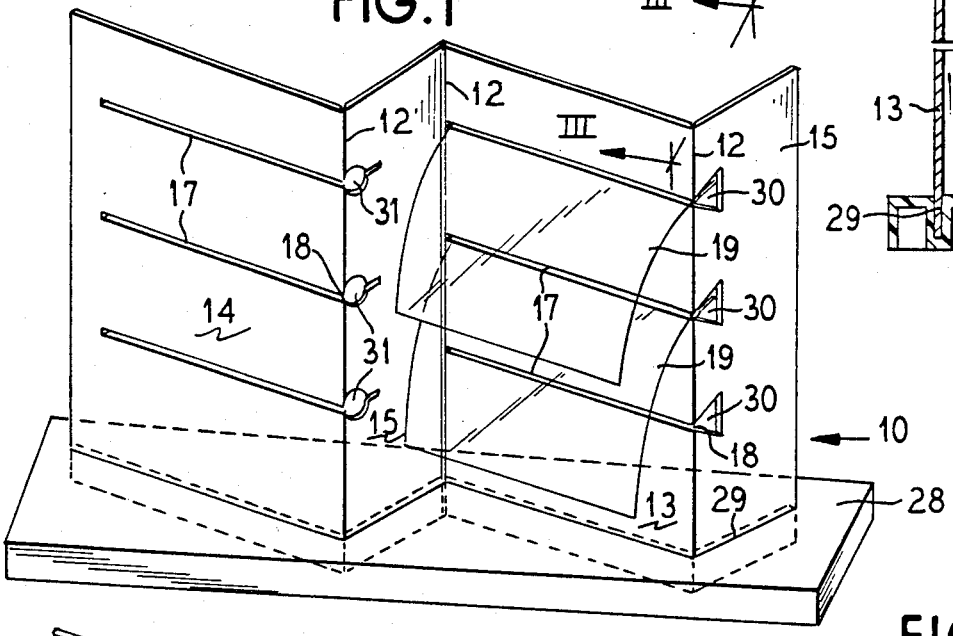
FIG. 1 is a perspective view of a bag storage device embodying the present invention.

In FIG. 1 a bag storage device 10 is depicted in the form of a display stand. Conveniently, the device 10 can be formed up inexpensively from a flat sheet 11 of self-sustaining sheet material such as cardboard and also sometimes referred to as paperboard, or from rigid plastic sheet, or the like. The sheet 11 is divided by vertical bends along lines 12 into bag supporting members or panels 13 and 14 and stiffener or reinforcement panels 15. One of the panels 15 is shown as located along the right hand side of the panel 13, and another of the panels 15 is shown as connecting the adjacent sides of the supporting panels 13 and 14.

Each of the supporting panels 13 and 14 has transversely or horizontally extending vertically spaced slots 17, each of which has an entrance 18 at the right hand end of the slot, that is, the end at which the associated reinforcing panel 15 is attached by means of the bend juncture 12 to the panel 13 or 14, as the case may be.

Figure 4:
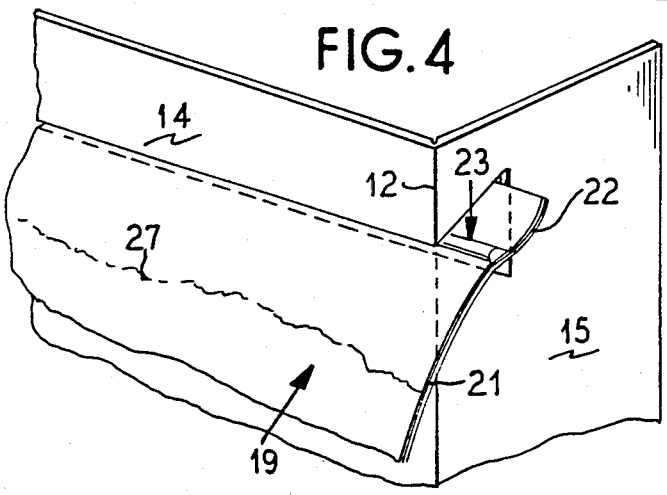
FIG. 4 is a fragmentary enlarged perspective view showing how a bag is adapted to be mounted or removed relative to the storage device.
Figure 5:
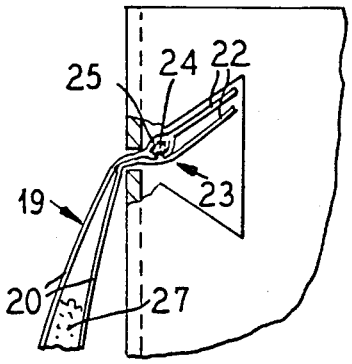
FIG. 5 is a fragmentary elevational view looking leftward toward FIG. 4.

Each of the slots 17 is adapted to receive, for support on the slotted panel, a bag 19, a representative example of which is depicted in FIGS. 4 and 5. The bag 19 may be of the widely popular kind formed up from thin sheet plastic, generally referred to as film, and comprising confronting walls closed along at least the bottom end and sides such as by means of folds or heat sealed seams 21, as the case may be. At an upper or mouth end of the bag 19, the walls 20 provide pull flanges 22 along the lower ends of which is an extruded plastic reclosable fastener 23.

In one of the desirable forms the fastener 23 comprises releasably interlockable profiles one of which is a generally arrow shaped cross-section male profile 24 and the other is a generally channel shaped female profile 25. In the example shown, the profiles 24 and 25 are extruded integrally with the respective wall panels 20 on which the profiles are carried in complementary alignment with one another across the upper end portion of the bag. Because of the greater mass structure of the profiles 24 and 25, they provide, in the closed condition of the fastener 23 a rib (which will now also be identified as 23) of substantially greater thickness than the adjacent thickness of the closed bag, that is, the double thickness of the thin film bag walls 20 adjacent to the rib 23.

Figure 2:
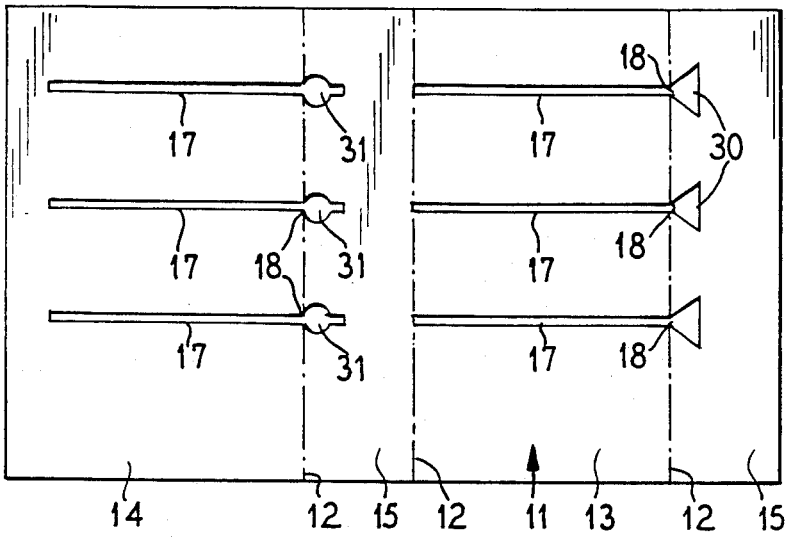
FIG. 2 is a plan view of a blank to be set up to provide the device of FIG. 1.
Figure 3:
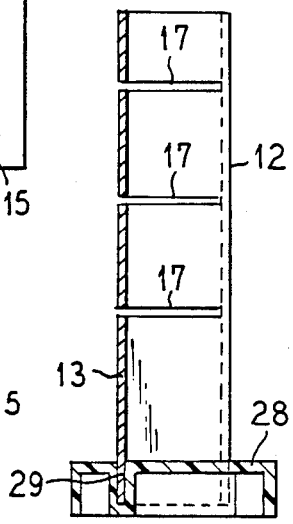
FIG. 3 is a vertical sectional detail view taken substantially in the plane of line III—III in FIG. 1.

It is the thickness differential which exists between the rib 23 and the bag walls 20 that is utilized in the provision for storing bags like the bag 19 on the storage device 10. To this end, the slots 17 are narrower than the thickness of the rib 23, but of a width which will freely receive the bag top portion thickness, that is the thickness adjacent to the rib 23, and, of course, on the side of the rib 23 opposite to that from which the pull flanges 22 extend. This relationship permits the bag 19 or respective bags 19 to be mounted on the panels 13 and 14 by inserting the top end portions of each of the bags just below the rib structure 23 into the entrance 18 and moving the bag onto and along the selected slot 17. The rib 23 will thus be at one side of the slot, i.e., at the inside of the associated panel 13 or 14, and the remainder of the bag 19 will be at the opposite side of th4 slot, i.e., the outer side of the associated panel 13 or 14. Thereby, the rib 23, since it cannot escape from the associate slot 17 except through the entrance 18, provides a secure interlock with the associated supporting panel for holding the bag in storage position. Where the storage position is in a display orientation of the device 10 as depicted in FIGS. 1 and 3, contents 27 within the bag 19 can be readily observed where the bag walls 20 are transparent, or at least a portion of the front bag wall 20 aligned with the contents 27 is transparent.

In the set-up display condition of the device 10, the reinforcing panels 15 are, as shown, turned angularly relative to the panels 13 and 14 and stiffen and reinforce the edges of the panels 13 and 14, and provide standup support for the display.

Additional support for the thus set-up device 10 may be provided by a suitable base 28 which may be a molded plastic structure substantially as shown and which has means such as a groove socket 29 of generally zigzag form complementary to and receptive of the lower ends of the panels qf the device. The device 10 is thereby supported in a firm, stable relation. Although the lower ends of the panels may be permanently secured in the slot socket 29, they may also be slidably insertable and removable so that the device 10 provides a knockdown assembly for convenient storage and shipment.

For readily clearing the rib 23 and the pull flanges 22 when the bag 19 is passed through the entrance 18 of the selected slot 17, the reinforcing panel 15 along the slot entrance side of the panel 13 is provided with clearance openings 30 which may be of any desirable shape but are shown as of trianglular shape aligned with the respective entrances 18, and as of round or keyhole shape openings 31 along the side of the panel 14.

As will be apparent, the panel sheet 11 can be inexpensively die stamped to cut the slots 17 and the clearance openings 30 and 31 therein, and to crease the bend joints 12.

It will be appreciated that although the device 10 has been depicted as comprising the pair of bag supporting panels 13 and 14 with three of the bag receiving slots 17 in each of these panels, that this is only representative. There may be any number of the supporting panels and any number of bag receiving slots in such panels as may be desired for any particular situation. There may even be just one of the supporting panels. The length of the slots 17 may be complementary to the width of the bags 19, but if desired, the slots may be of a length which is a multiple of the bag widths so that a plurality of the bags may be supported at each of the slots 17. When more than one of the slots 17 is loaded with the bags 19, the bags may hang down in overlapping relation as seen in FIG. 1

Figure 6:
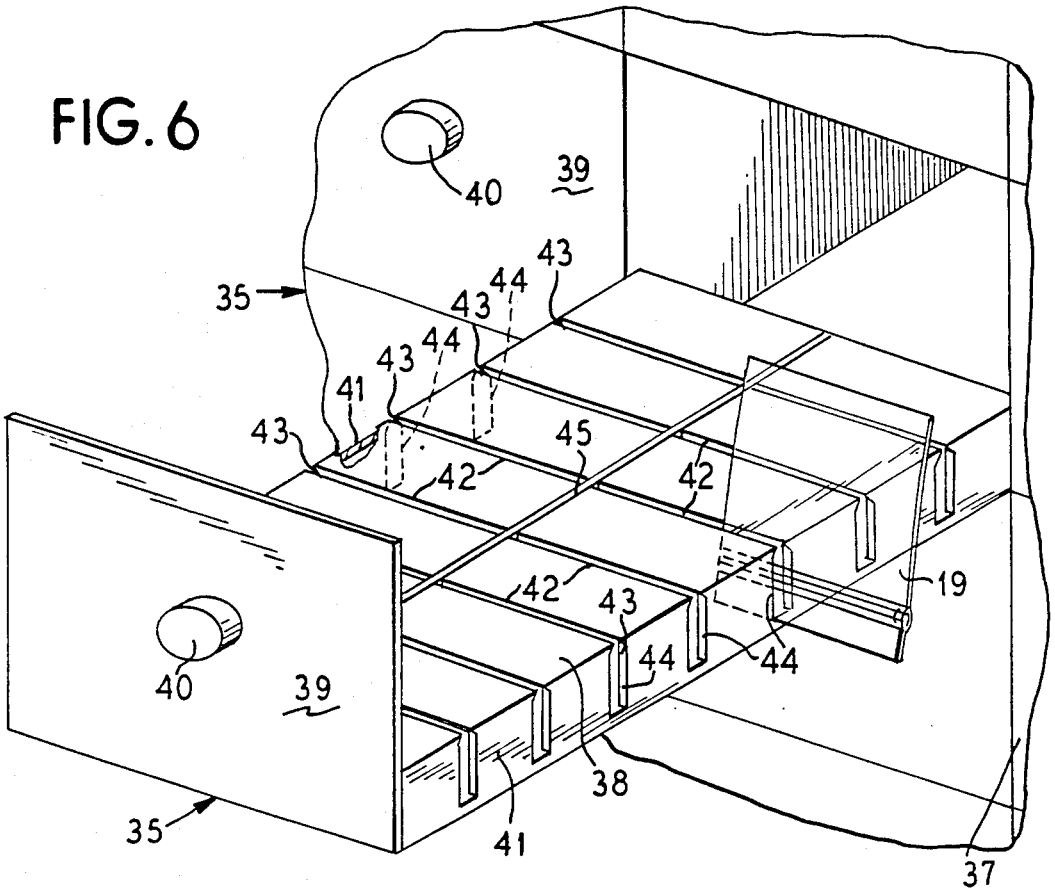
FIG. 6 is a schematic perspective view showing a modified bag storage device embodying the present invention.
Figure 7:
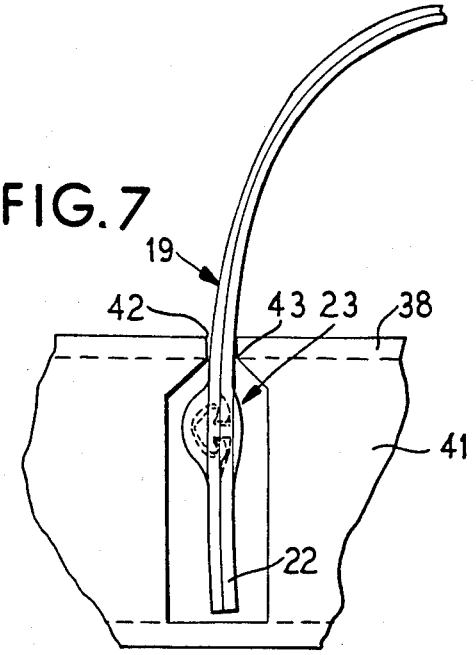
FIG. 7 is an enlarged fragmentary elevational view showing an entrance into one of the bag receiving slots of the device of FIG. 6.

In another desirable form of the invention as depicted in FIGS. 6 and 7, a storage device 35 is in the form of a drawer arranged to be supported in a pull-out relation within a cabinet 37. There may be one of the drawers 35 or there may be a plurality of such drawers 35, as shown in respect to the cabinet 37. In a desirable construction, the drawer 35 may comprise a flat horizontal bag-supporting base panel 38 having attached to its front end a drawer front 39 which may be equipped with a suitable pull which may be in the form of a knob or any other desired configuration. Along each side of the panel 38 is an angular, depending, stiffening or reinforcing panel 41.

For interlockably receiving the bags 19, the member or panel 38 has at spaced intervals therealong transverse bag receiving slots 42 each of which has at the side edge of the panel an entrance 43 with an aligned clearnace opening 44 in the side reinforcing panel 41. Through this arrangement, a bag 19 is adapted to be received interlockably in each of the slots 41 by inserting the rib 23 and the pull flanges 22 of the bag through the opening 44 and inserting the adjacent bag wall portion through the entrance 43 into the slot 42. Since the slots 42 are substantially narrower than the thickness of the rib 23, but wide enough to receive the adjacent portion of the bag freely, it will be apparent that the bags 19 which are mounted in place in the storage device drawer 35 will be effectively interlocked against pulling out across the retaining slots 42, but can be readily maneuvered into and out of position in the slots through the entrances 43 and clearance openings 44. Within the drawer, the bags may be accommodated in overlapped relation.

For multiplying the bag capacity of the drawer 35, the slots 42 may be of length which is a multiple of the widths of the bags to be supported so that a plurality of bags can be engaged with respect to each of the slots 42. To enhance this expanded bag capcity, each of the slots 42 may have an entrance 43 at each side of the panel member 38, or there may be disconnected slots 42 having entrances 43 at the respective opposite sides of the panel 38.

In a convenient arrangement, for stiffening the panel 38 when it is of substantial width and formed from relatively thin material, a longitudinal central partition 45 may be provided, thus in effect, dividing the panel 38 into a left hand and a right hand supporting area, with each equipped with the bag receiving slots 42 and with the slots having respective entrances at oppostie sides of the panel 38. It may be noted that the left hand side of the drawer 35 may be equipped with reinforcing angular side panel structure 41 similarly as the same structure 41 at the right hand side, and with the left hand reinforcing panel 41 provided with clearance openings 44 in alignment with the entrances 43 in similar fashion as at the right side of the drawer.

It will be apparent that various modifications and/or additions may be made in the apparatus of the invention without departing from the essential feature of novelty involved, which are intended to be defined and secured by the appended claims.

We claim as our invention:

1. A combination of a storage device and bag of selected width and length and each having a top end portion with a rib extending thereacross, and said rib being of greater thickness than the thickness of the top end portion, said combination comprising:

a member having at least one slot substantially as long as the bag width;

said slot being narrower than the rib thickness but of a width which will freely receive said bag top portion thickness; and an entrance into said slot through which said top end portion of the bag can be insert by movement longitudinally along the slot for storage of the bag on said device with the rib located at one side of the slot and the remainder of the bag located at the opposite side of the slot.

2. A combination according to claim 1, wherein said entrance is located at an edge of said member and in an angular reinforcement along said member edge, with a clearance opening aligned with said entrance.

3. A combination according to claim 1, wherein said member comprises an upright display panel.

4. A combination according to claim 1, wherein said member comprises a base panel within a drawer.

5. A combination according to claim 4, wherein said base panel has a spaced plurality of said slots and entrances into said slots along a longitudinal edge of said panel.

6. A combination according to claim 5, wherein said drawer has an angular depending reinforcement along said edge of the panel and said reinforcement has clearance openings aligned with said slots.

7. A combination according to claim 4, wherein said panel has a plurality of bag receiving slots, and with entrances into said slots at each of opposite side of said panel.

8. A combination device according to claim 1, wherein said member comprises a panel which is one of a plurality of similar panels connected together by angular narrower reinforcing panel means, each of said panels having a plurality of spaced bag receiving slots.

9. A combination according to claim 1, including means for supporting the device in an upright display mode.

10. A combination of a storage device and bags of selected width and each having a top end portion with a rib extending thereacross of greater thickness than the thickness of the top end portion of the bag, comprising:

a member arranged to be supported in upright position as a display panel and having at least one slot substantially as long as the bag width;

said slot being narrower than the rib thickness but of a width which will freely receive said bag top portion thickness; and an entrance into the slot through which the top end portion of the bag can be received for support of the bag with the rib at a rear side of said slot and the remainder of the bag at the front side of said slot.

11. A combination according to claim 10, wherein said entrance is located at an edge of said member and in an angular reinforcement along said member edge, with a clearance opening aligned with said entrance.

12. A combination according to claim 10, wherein said panel is one of a plurality of similar panels connected together by angular narrower reinforcing panel means, each of said panels having a plurality of spaced bag receiving slots.

13. A combination according to claim 12, including means for supporting the device in said upright position.

14. A combination storage device and bags of selected width and each having a top end portion with a rib extending thereacross and of greater thickness than the thickness of the top end portion of the bag, comprising:

a member comprising a base panel of a drawer and having at least one slot therein substantially as long as said bag width;

said slot being narrower than the rib thickness but of a width which will freely receive said bag portion thickness; and an entrance into one end of said slot through which the top end portion of the bag can be slidably inserted for storage of the bag with the rib at the lower side of the slot and the remainder of the bag at the top side of the slot.

15. A combination according to claim 14, wherein said base panel has a spaced plurality of said slots and entrances into said slots along a longitudinal edge of said base panel.

16. A combination according to claim 15, wherein said drawer has an angular depending reinforcement along said edge of the panel and said reinforcement having clearance openings aligned with said slots.

17. A combination according to claim 14, wherein said panel has a plurality of bag receiving slots, and with entrances into said slots at each of opposite sides of said panel.

* * * * *